US009279561B1

(12) United States Patent
Bohler

(10) Patent No.: US 9,279,561 B1
(45) Date of Patent: Mar. 8, 2016

(54) SYSTEMS, METHODS, AND DEVICES FOR PROVIDING AN LED-BASED LINEAR FLUORESCENT REPLACEMENT LAMP

(71) Applicant: Christopher Lee Bohler, Peachtree City, GA (US)

(72) Inventor: Christopher Lee Bohler, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 323 days.

(21) Appl. No.: 13/706,006

(22) Filed: Dec. 5, 2012

Related U.S. Application Data

(60) Provisional application No. 61/567,412, filed on Dec. 6, 2011.

(51) Int. Cl.

| | |
|---|---|
| ***F21V 7/04*** | (2006.01) |
| ***F21V 7/00*** | (2006.01) |
| ***F21V 29/00*** | (2015.01) |
| ***F21K 99/00*** | (2010.01) |

(52) U.S. Cl.
CPC ... *F21V 7/00* (2013.01); *F21K 9/10* (2013.01); *F21K 9/17* (2013.01); *F21V 29/00* (2013.01); *F21K 9/175* (2013.01)

(58) Field of Classification Search
CPC ..... F21K 9/10; F21K 9/17; F21K 9/175
USPC ..... 362/555
See application file for complete search history.

(56) References Cited

U.S. PATENT DOCUMENTS

| | | | | |
|---|---|---|---|---|
| 5,806,965 | A * | 9/1998 | Deese | 362/249.04 |
| 2006/0018125 | A1 * | 1/2006 | Miller et al. | 362/554 |
| 2008/0055928 | A1 * | 3/2008 | Arai | 362/609 |
| 2010/0027259 | A1 * | 2/2010 | Simon et al. | 362/245 |

OTHER PUBLICATIONS

Langevin, John. LED Backlight Technology Offers Promising Choice for Lighting. LEDs Magazine. Nov. 2011.
LED Lighting Solutions for Affordable and Energy-Efficient General Lighting. *Display Plus*. Mar. 19, 2011.
Cree Prototype Exceeds DOE's 21st Century Lamp L PrizeSM Requirements. Cree.com. Aug. 1, 2011.

* cited by examiner

*Primary Examiner* — Sean Gramling
(74) *Attorney, Agent, or Firm* — King & Spalding LLP

(57) ABSTRACT

A light emitting diode (LED) lamp tube for replacing a linear fluorescent lamp that includes an inner tube wall, an outer tube wall, at least one LED array, and at least one waveguide, where the at least one LED array is coupled to an inner surface of the inner tube wall. The at least one waveguide is coupled to the end of the outer tube and is configured to reflect light emitted from the at least one LED array toward a space located between the inner tube wall and the outer tube wall.

22 Claims, 5 Drawing Sheets

SYSTEMS, METHODS, AND DEVICES FOR PROVIDING AN LED-BASED LINEAR FLUORESCENT REPLACEMENT LAMP

RELATED APPLICATIONS

The present application claims priority to U.S. Provisional Patent Application No. 61/567,412, filed Dec. 6, 2011, and titled "Systems, Methods, And Devices For Providing A Led-Based Linear Fluorescent Replacement Lamp," the entire contents of which is incorporated herein by reference.

TECHNICAL FIELD

Embodiments relate generally to lighting solutions, and more particularly to systems, methods, and devices for providing a light emitting diode (LED) light fixture.

BACKGROUND

LED-based linear fluorescent replacement lamps are becoming more popular as LED source performance continues to improve. However, conventional LED-based solutions often either suffer from pixelization caused by the displacement of multiple LEDs along the length of the lamp and/or inefficiencies caused by a lack of uniformity of illumination along the length of the lamp.

BRIEF DESCRIPTION OF THE DRAWINGS

Reference will now be made to the accompanying drawings, which are not necessarily drawn to scale, and wherein.

SUMMARY

Figure 1A:
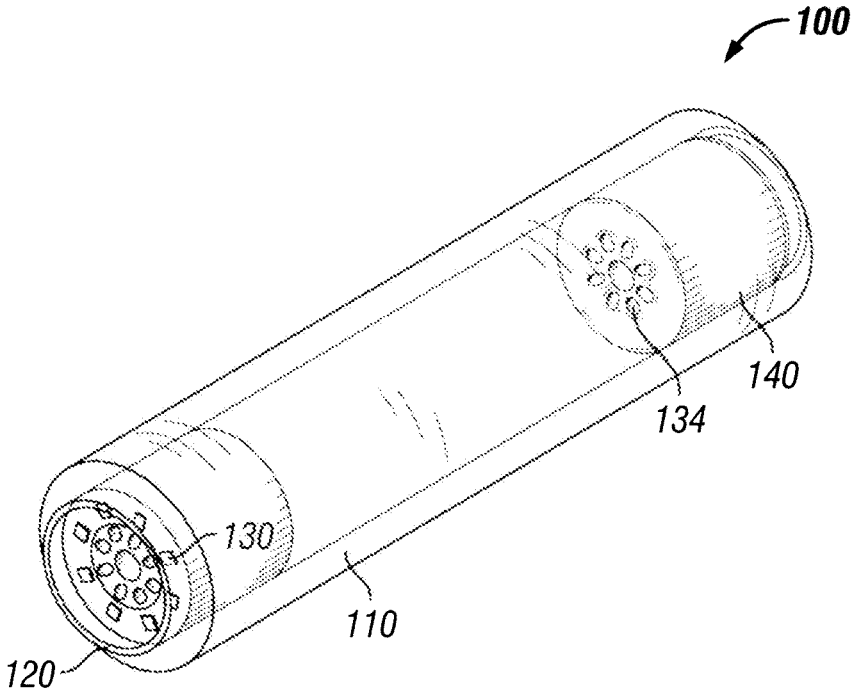
FIGS. 1A and 1B show a perspective view and a cross-sectional side view, respectively, of a LED-based linear fluorescent replacement lamp in accordance with one or more example embodiments.

A light emitting diode (LED) lamp tube for replacing a linear fluorescent lamp that includes an inner tube wall, an outer tube wall, at least one LED array, and at least one waveguide, where the at least one LED array is coupled to an inner surface of the inner tube wall. The at least one waveguide is coupled to the end of the outer tube and is configured to reflect light emitted from the at least one LED array toward a space located between the inner tube wall and the outer tube wall.

In a particular embodiment, a light emitting diode lamp tube for replacing a linear fluorescent lamp includes an outer tube wall. The outer tube wall includes a first end and a second end and has a first length. The light emitting diode lamp tube also includes an inner tube wall. The inner tube wall includes a third end and a fourth end and has a second length. The light emitting diode lamp tube further includes an LED array disposed adjacent to the third end of the inner tube wall, and a waveguide disposed adjacent the first end. The wave guide is configured to reflect light emitted from the LED array toward a space between the inner tube wall and the outer tube wall.

In another particular embodiment, an LED lamp tube for replacing a linear fluorescent lamp includes an outer tube wall that includes a first end and that has a first length. The LED lamp tube also includes an inner tube wall that includes a second end that has a second length. The LED lamp tube further includes an endcap that is coupled to the first end of the outer tube wall and to the second end of the inner tube wall. The endcap includes an LED array configured to emit light toward a space between the inner tube wall and the outer tube wall.

In another particular embodiment, an LED lamp for replacing a linear fluorescent lamp includes a first LED lamp tube and a second LED lamp tube coupled to the first LED tube. Each of the first lamp tube and the second lamp tube includes an outer tube wall that includes a first end and a second end and that has a first length. Each of the first lamp tube and the second lamp tube also includes an inner tube wall that includes a third end and a fourth end and that has a second length. Each of the first lamp tube and the second lamp tube further includes an LED array disposed adjacent to the third end of the inner tube wall and that is configured to emit light. Each of the first lamp tube and the second lamp tube also includes a waveguide disposed adjacent the first end and configured to reflect a portion of the light toward a space between the inner tube wall and the outer tube wall.

These and other aspects, features, and embodiments will become apparent to a person of ordinary skill in the art upon consideration of the following detailed description of illustrated embodiments.

DETAILED DESCRIPTION OF EXAMPLE EMBODIMENTS

The example embodiments discussed herein are directed to LED-based linear fluorescent replacement lamps. While generally described herein as being a linear fluorescent replacement lamps, it should be understood that each of the example embodiments described herein are not limited to being used solely as a replacement for a liner fluorescent lamp and can instead be configured for initial use in a fixture or fixtures that are designed to receive and use linear LED lamps or lamp modules.

The LED arrays described herein may include any type of LED technology, including but not limited to chip on board and discrete die. Further, while example embodiments described herein include a LED array and waveguide at each end of a LED-based linear fluorescent replacement lamp (and/or incorporated with an endcap), example embodiments may include a LED array and/or waveguide at only one end (or less than all ends if there are more than two ends) of the LED-based linear fluorescent replacement lamp.

In certain example embodiments, the lamps generate substantially uniform light across its length. In one or more example embodiments, the LED-based linear fluorescent replacement lamp includes a reflective element that directs light generated by one or more LED arrays down a tube to be emitted through the tube in a substantially uniform manner across the length of the tube. The example embodiments described herein may provide several advantages, including but not limited to increasing lamp efficiency and increasing customer satisfaction by providing a uniform light emission from the lamp. Further, one or more example embodiments described herein may provide a self-cooling mechanism to increase the efficiency and lifespan of the LED-based linear fluorescent replacement lamps. In addition, one or more example embodiments described herein may include an endcap (described below) that allows for modular assembly of multiple LED-based linear fluorescent replacement lamps in series so that various lengths of linear fluorescent lamps may be replaced using embodiments described herein.

Example embodiments of LED-based linear fluorescent replacement lamps now will be described more fully hereinafter with reference to the accompanying drawings, in which example embodiments of LED-based linear fluorescent replacement lamps are shown. LED-based linear fluorescent replacement lamps may, however, be embodied in many different forms and should not be construed as limited to the example embodiments set forth herein; rather, these example embodiments are provided so that this disclosure will be thorough and complete, and will fully convey the scope of LED-based linear fluorescent replacement lamps to those or ordinary skill in the art. Like, but not necessarily the same, elements in the various figures are denoted by like reference numerals for consistency.

Figure 1B:
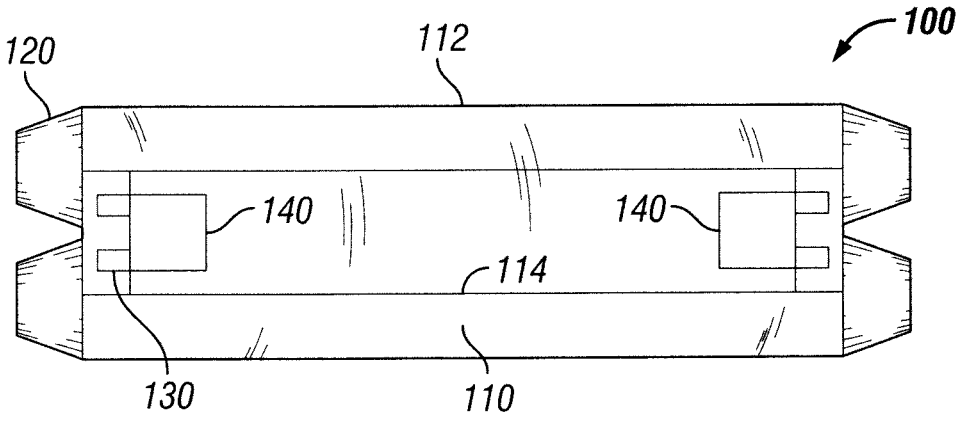

FIGS. 1A and 1B show a perspective view and a cross-sectional side view, respectively, of a LED-based linear fluorescent replacement lamp 100 in accordance with one or more example embodiments. The tube 110 of the LED-based linear fluorescent replacement lamp 100 is hollow in the middle and includes an outer tube wall 112 and an inner tube wall 114. The hollow middle portion of the tube 110 is surrounded by the inner tube wall 114 with the exception of the openings at the two ends of the tube 100. In a particular embodiment, the length of the outer tube wall 112 may differ from the length of the inner tube wall 114. The inner tube wall 114 may be coated or made of a reflective material (or a reflector material may be added inside the tube) so that little or no light enters the hollowed middle portion of the tube 110. For example, a reflective surface of the inner tube wall 114 may substantially prevent light reflected by the waveguide from passing through the inner tube wall 114.

Figure 1C:
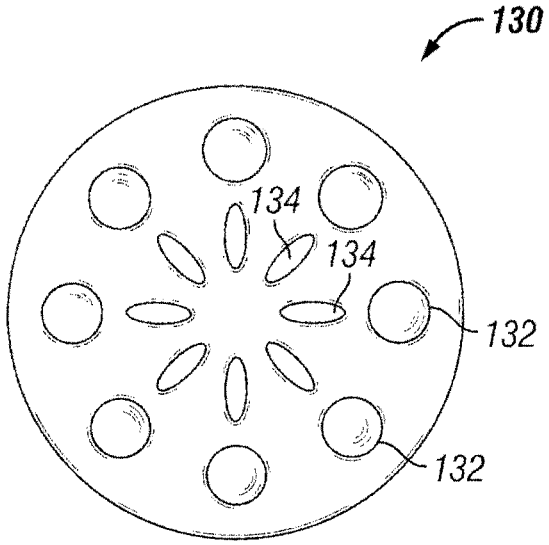
FIG. 1C shows an end view of an LED array of a LED-based linear fluorescent replacement lamp in accordance with one or more example embodiments.

In one or more example embodiments, an LED array 130 is positioned inside the hollow middle portion of the tube 100 at or near each end of the LED-based linear fluorescent replacement lamp 100. FIG. 1C shows an end view of an example LED array 130. In the example embodiment of FIG. 1C, the face of the LED array 130 is circular and includes eight LEDs 132 in a concentrically circular configuration; however, other shapes for the array and fewer or greater numbers of LEDs in the array are contemplated within the scope and spirit of this disclosure. In addition, the LED array 130 includes an inner, for example concentrically circular, array of vent holes 134, which traverse the LED array 130 and a heatsink 140 attached to the back of the LED array 130. In alternative embodiments, some or all vent holes of the array of vent holes 134 may be positioned on the outer portion of the LED array 130.

In one or more embodiments, each heatsink 140 is configured to maintain a temperature or range of temperatures of the LED array 130. Each heatsink 140 may be made of a material (e.g., copper, aluminum, steel) suitable for dissipating heat generated by the LED array 130. The array of vent holes 134 may traverse the heatsink 140 to create a "chimney" effect and allow for convective cooling of the LED array 130 and/or heatsink 140. The array of vent holes 134 may have any number, size, and or configuration of vent holes suitable to allow for convective cooling. In one or more embodiments, one or more other devices (e.g., a fan or pulse air emitter, or synthetic jet air emitter) may be inserted into the hollow portion of the tube 110 to increase circulation of cooling air through the vent holes 134.

Figure 1D:
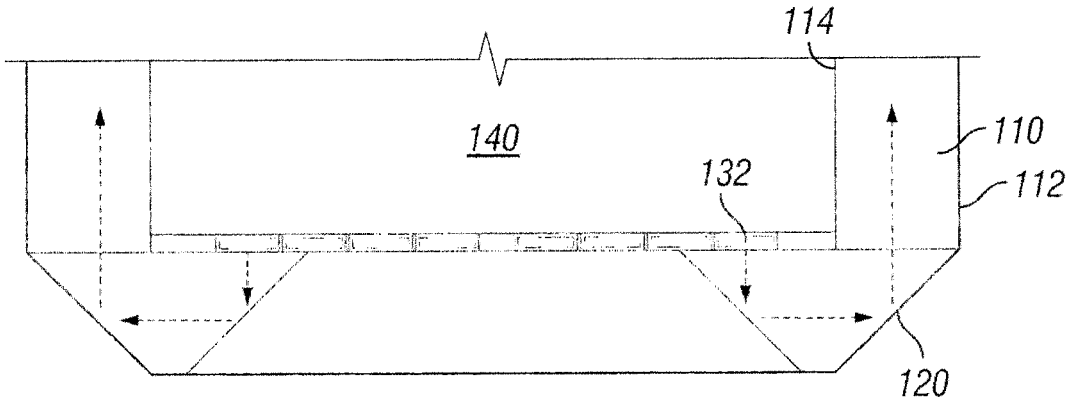
FIG. 1D shows a light path of light emitted by an LED array of a LED-based linear fluorescent replacement lamp in accordance with one or more example embodiments.

In one or more example embodiments, the light emitted by each LED in the LED array 130 in FIGS. 1A-1D is directed outward and along the length of the tube 110. As illustrated in FIGS. 1A, 1B, and 1D, the LED-based linear fluorescent replacement lamp 100 includes a waveguide 120. As more clearly shown in FIG. 1D, the waveguide 120 is configured to receive the light emitted by each LED in the LED array 130 and to reflect the light down the tube 110 between the inner tube wall 114 and the outer tube wall 112. Specifically, in one example embodiment, the waveguide 120 of FIG. 1D is conically shaped to reflect the light twice to send the light in approximately the opposite direction (i.e., down the length of the tube) from which the light is sent from the LED array 130. Alternatively, waveguides having other shapes and reflecting the light more or less than two times could be substituted herein.

The waveguide 120 may also be configured to allow controlled light leakage (i.e., control an amount of the light emitted by the LEDs 132 in the LED array 130 to leak through the walls of the waveguide 120). In such a case, the end of the LED-based linear fluorescent replacement lamp 100 where the waveguide 120 is located appears to be as illuminated as any other portion of the tube 110, removing any "deadspots" in the illuminated LED-based linear fluorescent replacement lamp 100 that are seen in conventional lamp tubes. Controlled light leakage may be performed in one or more of a number of ways, including, but not limited to, treating the outer beveled edge of the waveguide 120 with dichroic reflectors. In a particular embodiment, a reflector may be applied to the inner wall of the waveguide 120 to direct substantially all of the light emitted by the LEDS 132 out of the waveguide 120.

Figure 2A:
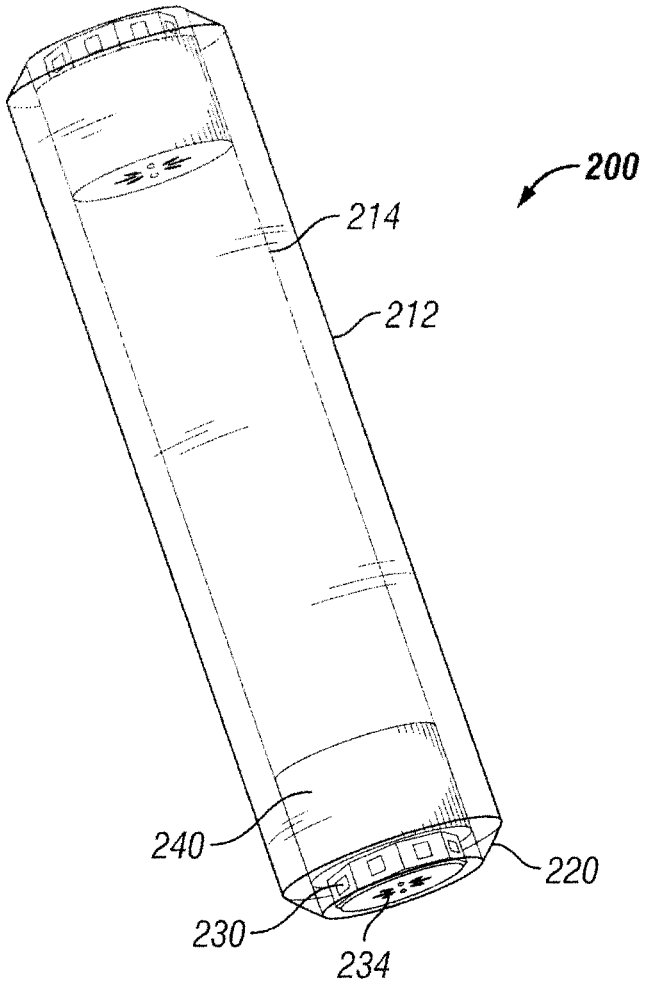
FIGS. 2A and 2B show a perspective view and a cross-sectional side view, respectively, of another LED-based linear fluorescent replacement lamp in accordance with one or more alternative example embodiments.
Figure 2B:
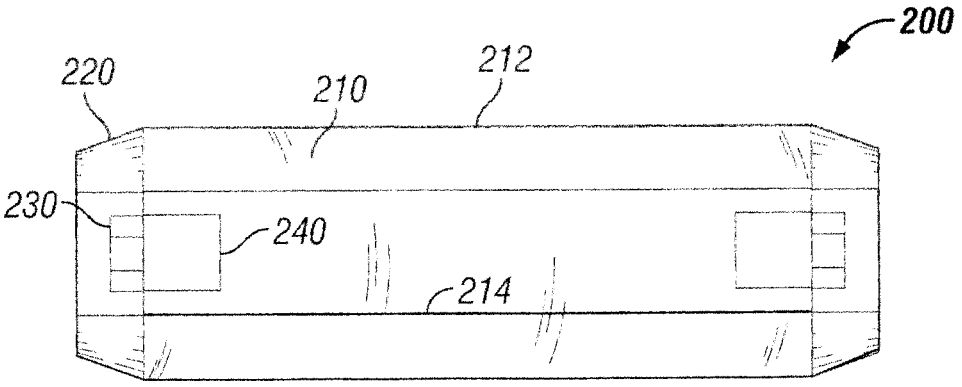

FIGS. 2A and 2B show a perspective view and a cross-sectional side view, respectively, of another LED-based linear fluorescent replacement lamp 200 in accordance with one or more alternative example embodiments. As described above with respect to the LED-based linear fluorescent replacement lamp 100 of FIGS. 1A and 1B, the LED-based linear fluorescent replacement lamp 200 shown in FIGS. 2A and 2B includes a tube 210 with an inner tube wall 214 and an outer tube wall 212, an LED array 230 with a heatsink 240 and vent holes 234, and a waveguide 220.

In this example, the LED array 230 directs the light perpendicular to the longitudinal axis of the tube of the tube 210. Further, the example waveguide 220 differs from the waveguide of FIGS. 1A, 1B, and 1D in that the waveguide 220 is chamfered. Specifically, the waveguide 220 reflects the perpendicularly traveling light from the LED array 230 approximately 90° so that the light will travel down the length of the tube 210 between the inner tube wall 214 and the outer tube wall 212. Further, the waveguide 220 may utilize total internal reflection (TIR) to maximize the light reflected down the length of the tube 210. Alternatively (or, in addition), the waveguide 220 may be treated, as with a metal reflector or dichroics. Similar to the waveguide 120 of FIGS. 1A, 1B, and 1D, the chamfer portion of the waveguide 220 may be optically treated so as to allow some light leakage to provide light uniformity in longer multiple tube "runs".

Figure 3A:
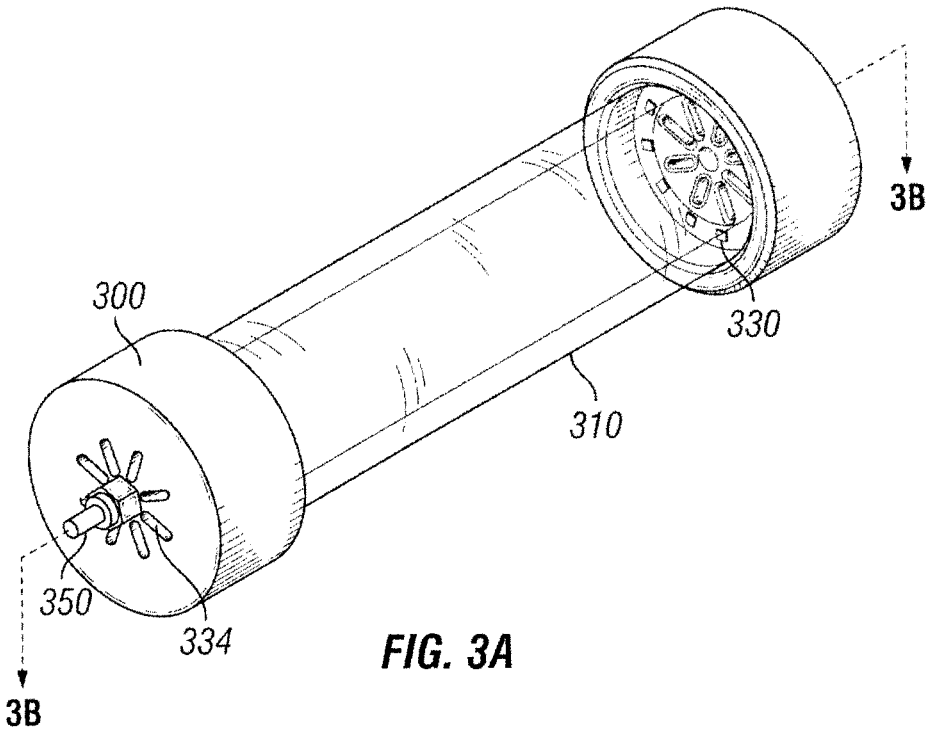
FIGS. 3A and 3B show views of an endcap in accordance with one or more example embodiments.
Figure 3B:
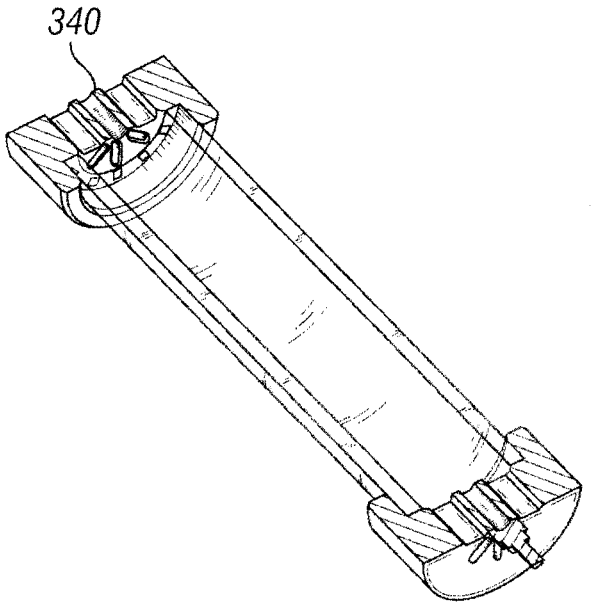

FIGS. 3A and 3B show an example endcap 300 that may be used to fit over an end of a LED-based linear fluorescent replacement lamp of FIGS. 1A-1B and 2A-2B according to one or more example embodiments. The endcap 300 may be configured to allow for end-to-end connection of two or more LED-based linear fluorescent replacement lamps. The endcap 300 may also be configured to facilitate an electrical connection to provide power and/or control to the LED-based linear fluorescent replacement lamp. In this example, the endcap 300 fits over the outer tube wall 310 and includes an LED array 330, vent holes 334, a heatsink 340, and an electrical connector 350.

In one or more example embodiments, the endcap 300 may include a waveguide (not shown in FIG. 3), while the LED array 330 is integrated with the LED-based linear fluorescent replacement lamp and directed toward the waveguide, as described above with respect to the LED-based linear fluorescent replacement lamp 100 of FIGS. 1A and 1B and the LED-based linear fluorescent replacement lamp 200 of FIGS. 2A and 2B. In such a case, the heatsink 340 and vent holes 334 may be integrated with the endcap 300 or the LED-based linear fluorescent replacement lamp. The endcap 300 may also be optically treated so as to allow some light leakage to provide light uniformity, where the endcap 300 couples to the end of one or more LED-based linear fluorescent replacement lamps, such as the LED-based linear fluorescent replacement lamp 100 of FIGS. 1A and 1B and/or the LED-based linear fluorescent replacement lamp 200 of FIGS. 2A and 2B. In a particular embodiment, the endcap 300 coupled to an LED-based linear fluorescent replacement lamp may also be coupled to an endcap of another LED-based linear fluorescent replacement lamp to enable serial connection of LED-based linear fluorescent replacement lamps.

Figure 4:
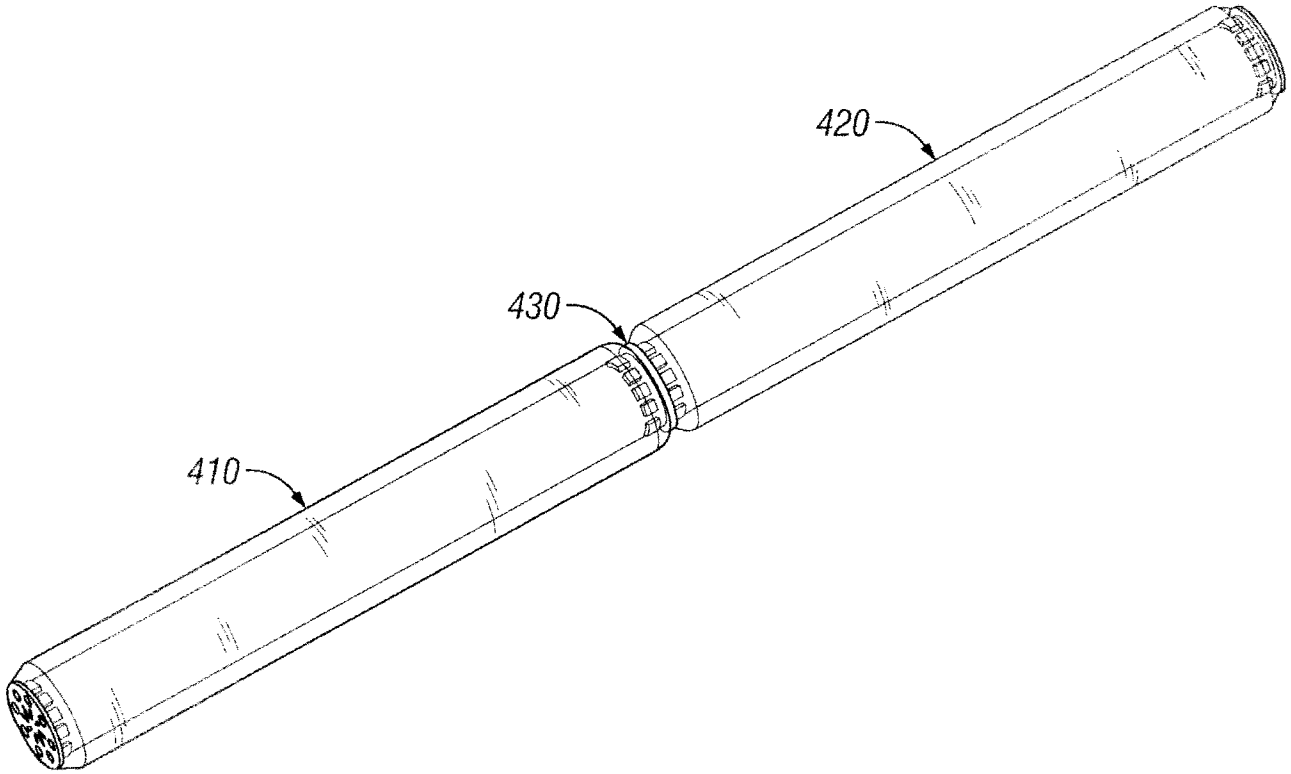
FIG. 4 shows an example embodiment of two LED-based linear fluorescent replacement lamps in a series configuration.

FIG. 4 shows an example embodiment of two LED-based linear fluorescent replacement lamps in a series configuration. In a particular embodiment, the first LED-based linear fluorescent replacement lamp 410 and the second LED-based linear fluorescent replacement lamp 420 may each correspond to the LED-based linear fluorescent replacement lamps 100 and 200 of FIGS. 1A-1B and 2A-2B, respectively, and operate in a similar manner.

In a particular embodiment, a waveguide of the first LED-based linear fluorescent replacement lamp 410 is coupled to a waveguide of the second LED-based linear fluorescent replacement lamp 420 at a contact point 430. For example, the waveguide (for example, the waveguide 120 or 220 shown in FIGS. 1A and 2A, respectively) of the first LED-based linear fluorescent replacement lamp 410 may be configured to allow a portion of the light emitted by the LED array of the first LED-based linear fluorescent replacement lamp 410 to pass through to the second LED-based linear fluorescent replacement lamp 420 at the contact point 430. Similarly, the waveguide of the second LED-based linear fluorescent replacement lamp 420 may be configured to allow a portion of the light emitted by the LED array of the second LED-based linear fluorescent replacement lamp 420 to pass through to the first LED-based linear fluorescent replacement lamp 410 at the contact point 430.

In alternative embodiments, the first LED-based linear fluorescent replacement lamp 410 and the second LED-based linear fluorescent replacement lamp 420 may include endcaps that are coupled to each other at the contact point 430. Alternatively, the first LED-based linear fluorescent replacement lamp 410 and the second LED-based linear fluorescent replacement lamp 420 may be coupled to a single endcap at opposite sides of the endcap.

In one or more of the example embodiments described above, the LED arrays of the LED-based linear fluorescent replacement lamp may be driven by an external LED driver. Alternatively, LED driver circuitry may be incorporated into the empty tube space occupied by the LED arrays and heatsinks. In such a case, one or more of the heatsinks may be configured to dissipate thermal from both the LED arrays and the LED driver circuitry. In such a case, the LED-based linear fluorescent replacement lamp may be connected directly to an alternating-current circuit.

While the LED-based linear fluorescent replacement lamps shown and described above are cylindrical in shape, other shapes may be used in one or more embodiments. For example, a LED-based linear fluorescent replacement lamp may be in the shape of a rectangular tube, a triangular tube, a tube having a cross-sectional shape of a pentagon, hexagon, heptagon, octagon or any other multi-sided shape, and a half-cylinder or any other partial cylinder having less than a 360 degree axis of rotation for light output. Further, non-linear and/or non-planar shapes may be used in one or more embodiments of LED-based linear fluorescent replacement lamps. Further, while embodiments described herein address LED replacement of existing linear fluorescent lamps (e.g., T12, T8, T5), other configurations and run lengths, whether stand-alone or in modular (e.g., connected in series) form, may be used.

Example embodiments of LED-based linear fluorescent replacement lamps described herein allow light emitted by LEDs to travel 1' to 8' without interruption to mimic a linear fluorescent lamp. Further, the example LED-based linear fluorescent replacement lamps described herein are thermally managed to meet lifetime and/or light output requirements. In addition, LED-based linear fluorescent replacement lamps allow for uniform illumination (i.e., no or minimal "dead zones" or light output fluctuations) across the length of the LED-based linear fluorescent replacement lamp and operate at efficient levels.

Accordingly, many modifications and other embodiments set forth herein will come to mind to one skilled in the art to which LED-based linear fluorescent replacement lamps pertain having the benefit of the teachings presented in the foregoing descriptions and the associated drawings. Therefore, it is to be understood that LED-based linear fluorescent replacement lamps are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A light emitting diode (LED) lamp for replacing a linear fluorescent lamp, the LED lamp comprising:

a lamp tube comprising:

an outer tube wall comprising a first end and a second end, the outer tube wall having a first length; and an inner tube wall comprising a third end and a fourth end, the inner tube wall having a second length;

an LED array disposed adjacent to the third end of the inner tube wall;

a waveguide disposed adjacent the first end and configured to reflect a portion of a light emitted from the LED array toward a space between the inner tube wall and the outer tube wall, wherein the space between the inner tube wall and the outer tube wall is hollow;

a second LED array disposed adjacent to the fourth end of the inner tube wall; and a second waveguide disposed adjacent to the second end and configured to reflect a portion of light emitted from the second LED array toward the space between the inner tube wall and the outer tube wall, wherein the waveguide is conically shaped, wherein a first surface of the second waveguide is configured to reflect the portion of the light emitted from the second LED array toward a second surface of the second waveguide, and wherein the second surface of the second waveguide is configured to reflect the portion of the light emitted from the second LED array and reflected by the first surface of the second waveguide toward the space between the inner tube wall and the outer tube wall.

2. The LED lamp of claim 1, wherein the waveguide is chamfered and configured to reflect the portion of the light emitted by the LED array toward the space between the inner tube wall and the outer tube wall.

3. The LED lamp of claim 1, wherein the inner tube wall includes a reflective surface that is configured to substantially prevent the portion of the light reflected by the waveguide toward the space between the inner tube wall and the outer tube wall from passing through the inner tube wall.

4. The LED lamp of claim 1, wherein the first length is different from the second length.

5. The LED lamp of claim 1, wherein the portion of the light emitted from the LED array and reflected by the waveguide travels approximately 1 to 8 feet to provide illumination similar to a linear fluorescent lamp.

6. The LED lamp of claim 1, wherein the waveguide is configured to allow a second portion of the light emitted from the LED array to leak through the waveguide.

7. The LED lamp of claim 6, wherein the waveguide includes a dichroic reflector to allow the second portion of the light emitted from the LED array to leak through the waveguide.

8. The LED lamp of claim 1, wherein the LED array comprises vent holes configured to enable convective cooling of the LED array.

9. A light emitting diode (LED) lamp assembly for replacing a linear fluorescent lamp, the LED lamp assembly comprising:

a first LED lamp; and a second LED lamp coupled to the first LED lamp, wherein each of the first LED lamp and the second LED lamp comprises:

a lamp tube comprising:

an outer tube wall comprising a first end and a second end, the outer tube wall having a first length; and an inner tube wall comprising a third end and a fourth end, the inner tube wall having a second length;

an LED array disposed adjacent to the third end of the inner tube wall, the LED array configured to emit light; and a waveguide disposed adjacent the first end and configured to reflect a portion of the light toward a space between the inner tube wall and the outer tube wall, wherein the space between the inner tube wall and the outer tube wall is hollow, wherein the waveguide of the first LED lamp is coupled to the waveguide of the second LED lamp, wherein the waveguide of the first LED lamp is configured to allow a second portion of the light emitted by the LED array of the first LED lamp to pass through to the lamp tube of the second LED lamp, and wherein the waveguide of the second LED lamp is configured to allow a second portion of the light emitted by the LED array of the second LED lamp to pass through to the lamp tube of the first LED lamp.

10. The LED lamp assembly of claim 9, wherein the LED array comprises vent holes configured to enable convective cooling of the LED array.

11. The LED lamp assembly of claim 9, wherein the waveguide is configured to allow a second portion of the light emitted from the LED array to leak through the waveguide.

12. A light emitting diode (LED) lamp for replacing a linear fluorescent lamp, the LED lamp comprising:

a lamp tube comprising:

an outer tube wall comprising a first end and a second end, the outer tube wall having a first length; and an inner tube wall comprising a third end and a fourth end, the inner tube wall having a second length;

an LED array disposed adjacent to the third end of the inner tube wall; and a waveguide disposed adjacent the first end and configured to reflect a portion of a light emitted from the LED array toward a space between the inner tube wall and the outer tube wall, wherein the waveguide is conically shaped and wherein a first surface of the waveguide is configured to reflect, toward the space between the inner tube wall and the outer tube wall, the portion of the light emitted from the LED array and reflected by a second surface of the waveguide.

13. The LED lamp of claim 12, further comprising:

a second LED array disposed adjacent to the fourth end of the inner tube wall; and a second waveguide disposed adjacent to the second end and configured to reflect a portion of light emitted from the second LED array toward the space between the inner tube wall and the outer tube wall.

14. The LED lamp of claim 12, further comprising a hollow middle portion that is partially surrounded by the inner tube wall, wherein the LED array and a heatsink are positioned in the hollow middle portion.

15. The LED lamp of claim 12, wherein the waveguide is conically shaped and wherein a first surface of the waveguide is configured to reflect, toward the space between the inner tube wall and the outer tube wall, the portion of the light emitted from the LED array and reflected by a second surface of the waveguide.

16. A light emitting diode (LED) lamp for replacing a linear fluorescent lamp, the LED lamp comprising:

a lamp tube comprising:

an outer tube wall comprising a first end and a second end, the outer tube wall having a first length; and an inner tube wall comprising a third end and a fourth end, the inner tube wall having a second length;

an LED array disposed adjacent to the third end of the inner tube wall;

a waveguide disposed adjacent the first end and configured to reflect a portion of a light emitted from the LED array toward a space between the inner tube wall and the outer tube wall, wherein the space between the inner tube wall and the outer tube wall is hollow;

a heatsink configured to dissipate heat generated by the LED array; and a hollow middle portion that is partially surrounded by the inner tube wall, wherein the LED array and the heatsink are positioned in the hollow middle portion.

17. The LED lamp of claim 16, wherein the first length is different from the second length.

18. The LED lamp of claim 16, wherein the LED array comprises vent holes configured to enable convective cooling of the LED array and/or the heatsink.

19. The LED lamp of claim 16, further comprising:

a second LED array disposed adjacent to the fourth end of the inner tube wall; and a second waveguide disposed adjacent to the second end and configured to reflect a portion of light emitted from the second LED array toward the space between the inner tube wall and the outer tube wall.

20. A light emitting diode (LED) lamp assembly for replacing a linear fluorescent lamp, the LED lamp assembly comprising:

a first LED lamp; and a second LED lamp coupled to the first LED lamp, wherein each of the first LED lamp and the second LED lamp comprises:

a lamp tube comprising:

an outer tube wall comprising a first end and a second end, the outer tube wall having a first length; and an inner tube wall comprising a third end and a fourth end, the inner tube wall having a second length;

an LED array disposed adjacent to the third end of the inner tube wall, the LED array configured to emit light; and a waveguide disposed adjacent the first end and configured to reflect a portion of the light toward a space between the inner tube wall and the outer tube wall, wherein the space between the inner tube wall and the outer tube wall is hollow and wherein the inner tube wall partially surrounds a hollow middle portion, wherein the LED array and the heatsink are positioned in the hollow middle portion.

21. The LED lamp assembly of claim 20, wherein the LED array comprises vent holes configured to enable convective cooling of the LED array and/or the heatsink.

22. The LED lamp assembly of claim 20, wherein the waveguide is configured to allow a second portion of the light emitted from the LED array to leak through the waveguide.

* * * * *